United States Patent [19]

Tajima et al.

[11] Patent Number: 4,936,249

[45] Date of Patent: Jun. 26, 1990

[54] DEVELOPING APPARATUS HAVING A TWO POLE STATIONARY MAGNET

[75] Inventors: Hatsuo Tajima, Matsudo; Takahiro Kubo, Tokyo, both of Japan

[73] Assignee: Canon Kabushiki Kaisha, Tokyo, Japan

[21] Appl. No.: 254,151

[22] Filed: Oct. 6, 1988

[30] Foreign Application Priority Data

| | | | |
|---|---|---|---|
| Oct. 7, 1987 | [JP] | Japan | 62-251628 |
| Oct. 7, 1987 | [JP] | Japan | 62-251630 |
| Oct. 7, 1987 | [JP] | Japan | 62-251631 |
| Oct. 7, 1987 | [JP] | Japan | 62-251633 |
| Nov. 4, 1987 | [JP] | Japan | 62-277350 |

[51] Int. Cl.[5] ..... G03G 15/09

[52] U.S. Cl. ..... 118/658; 355/251

[58] Field of Search ..... 355/251, 253; 118/657, 118/658; 430/122

[56] References Cited

U.S. PATENT DOCUMENTS 4,444,864 4/1984 Takahashi ..... 118/658 X

FOREIGN PATENT DOCUMENTS 54-43027 4/1979 Japan ..... 355/253

62-43678 2/1987 Japan ..... 355/251

*Primary Examiner*—Joan H. Pendegrass

*Attorney, Agent, or Firm*—Fitzpatrick, Cella, Harper & Scinto

[57] ABSTRACT

A developing apparatus including a cylindrical member having an outer diameter of 5–25 mm to carry a developer. In the cylindrical member, there is disposed a stationary magnet having only two magnetic poles adjacent an outer periphery thereof. An elastic member is contacted to said cylindrical member to regulate the thickness of the developer layer.

27 Claims, 10 Drawing Sheets

DEVELOPING APPARATUS HAVING A TWO POLE STATIONARY MAGNET

FIELD OF THE INVENTION AND RELATED ART

The present invention relates to a developing apparatus for developing an electrostatic latent image.

A developing apparatus is known wherein a stationary magnetic field generating means is disposed within a rotatable cylindrical developer carrying member made of non-magnetic material, and a developer is conveyed, while being retained on the developer carrying member by the magnetic field generating means, to a developing zone or position after the developer is regulated into a layer of developer having a predetermined thickness by contact pressure using a thin rubber plate or the like. In the developing zone, the developer is transferred onto the electrostatic latent image bearing member to develop the electrostatic latent image (U.S. Pat. Nos. 4,458,627, 4,356,245, 4,391,891, 4,377,332). In such a developing apparatus, the developer is magnetically retained on the cylindrical developer carrying member, and therefore, a magnetic field has to be formed around the developer carrying member. To do this, a magnet having four or more magnetic poles adjacent an outer periphery thereof, is generally used. However, the magnet having four or more magnetic poles is expensive to manufacture, and the size of the magnet is required to be large, making it difficult to reduce the size of the developing apparatus.

A developing apparatus using a magnet having two magnetic poles is disposed in a Japanese Laid-Open Patent Application Publication No. 31139/1978, and such a developing device is disclosed in U.S. Ser. No. 210,250. In these, a small diameter developer carrying member is used. Japanese Laid-Open Patent Application 31139/1978 does not disclose means for forming a thin layer of the developer on the surface of the developer carrying member. U.S. Ser. No. 210,250 discloses a blade disposed with a clearance from the developer carrying member as a means for forming a thin layer of the developer. When the diameter of the developer carrying member is small, the period during which the developer is subjected to the triboelectrification with the image bearing member from the developer supply position to the developing position is short. Therefore, the amount of triboelectrification is sometimes not sufficient with the result of insufficient image density.

In an apparatus wherein a thin layer of the developer is formed using a magnetic blade as shown in U.S. Pat. No. 4,387,664, the position of the magnetic blade is limited to a small area. Therefore, if an attempt is made to incorporate such a magnetic blade into a developing apparatus using such a small size developer carrying member, the latitude for the structure of the apparatus decreases. Particularly, it becomes difficult to provide a large area for the supplying position, and therefore the region for replacing the developer carried on the developer carrying member after the developing action with a fresh developer.

SUMMARY OF THE INVENTION

Accordingly, it is a principal object of the present invention to provide a developing apparatus using a small diameter developer carrying member.

It is another object of the present invention invention to use a small diameter developer carrying member, and wherein the developer is sufficiently triboelectrically charged.

It is a further object of the present invention to provide a developing apparatus using a small diameter developer carrying member, wherein the latitude for the structure of the apparatus is large.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
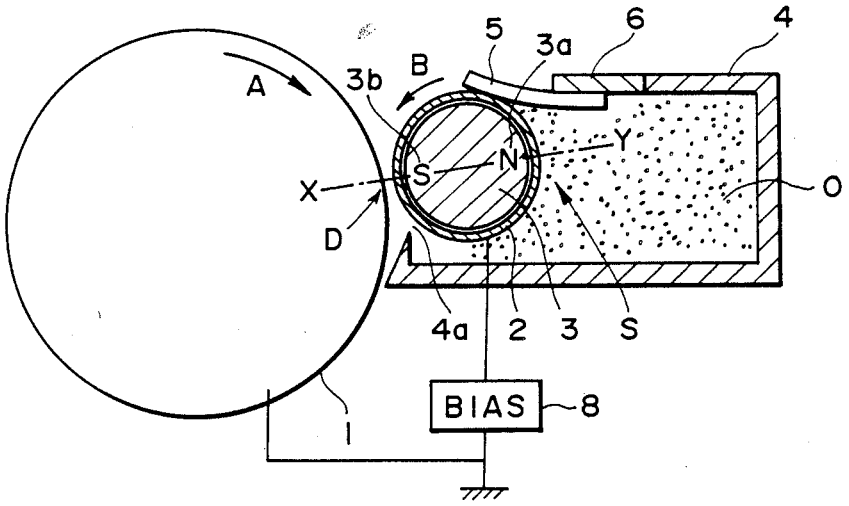
FIG. 1 is a sectional view of a developing apparatus according to an embodiment of the present invention.

Referring to FIG. 1, there is shown a developing apparatus according to an embodiment of the present invention, wherein a reference numeral 1 designates an electrophotographic photosensitive drum rotatable in a direction indicated by an arrow A and bearing a latent image to be developed by the developing apparatus. On the drum 1 is a surface layer made of an electrophotographic photosensitive material (OPC or the like), on which an electrostatic latent image is formed through a process known as Carlson process, and the latent image is developed at the developing position or zone D. Around the drum 1, there are charging means, exposure means, image transfer means, cleaning means and others, which are of one of known type, and therefore, the detailed description thereof are omitted for the sake of simplicity.

As for the developer, a so-called one component magnetic developer or a two component developer containing magnetic carrier particle and toner particles in mixture may be used. In this specification both of such developers are referred to as a magnetic developer.

The developing device comprises a developer container 4 having an opening 4A in its front wall and accommodating therein a magnetic developer O of one component or two component type. The developing apparatus further comprises a developing sleeve 2 in the form of a cylinder made of non-magnetic material. The developing sleeve 2 functions as a rotatable developer carrying member disposed in the opening with a part thereof exposed out of the developer container 4 so that the developing sleeve 2 is opposed to the photosensitive drum 1 with a clearance at the developing zone. The apparatus further comprises a regulating member 5 made of a thin non-magnetic plate resiliently contacted to the developing sleeve 2. The regulating member 6 is fixedly mounted to the container 4 through a holder 6. In the developing sleeve 2, a magnet roll 3 (magnetic field generating means) is stationary disposed, and it has two magnetic poles 3*a* and 3*b*. In this embodiment, the regulating member 5 is of a urethane rubber having a thickness of 1 mm and a hardness of 65 degrees.

As for the materials usable for the regulating member 5, there are nitrile rubber, fluorine rubber, silicone rubber, ethylene propyrene rubber or the like. The regulating member 5 is preferably made of a material which electrically charges the toner particles to a polarity required for developing the latent image, by frictional action with the toner. The two pole magnet may be manufactured by a method disclosed in Japanese Laid-Open Patent Application Publication No. 31139/1978 wherein an alloy of mangane, aluminum and carbon is formed into a circular rod and is magnetized, or by a method disclosed in Japanese Laid-Open Patent Application No. 108,207/1981 wherein a mixture of magnetic material and thermoplastic high polymer materials heated to fused, and thereafter, it is injected into a metal mold having a predetermined roll-shape inside surface, while a magnetic field corresponding to a magnetization pattern is applied to the periphery of the metal mold; then, the mixture is cooled and solidified to produce a magnet roll for formation of the magnetic brush. Although the diameter of the magnet is small, a magnet having a sufficient magnetic force for use of the developing apparatus can be provided since only the two magnetic poles are provided. It is preferable that the magnetic poles 3*a* and 3*b* are disposed symmetrically about a center of the magnet roll 3, that is, on a diameter of the roll 3, since then the magnetic force by the magnetic poles 3*a* and 3*b* can be made strong. However, this is not absolutely required.

As described above, the developing sleeve 2 rotates in the direction indicated by an arrow B (counterclockwise direction), while one component or two component magnetic developer O is retained on the surface of the developing sleeve 2 by the magnetic force provided by the magnet roll. In this manner, the developer is carried on the sleeve 2 to the developing zone D out of the developer container. In this embodiment, the developing sleeve 2 and the photosensitive drum 1 are spaced apart with a predetermined clearance. However, the present invention is applicable to such a developing apparatus in which they are contacted, that is, in which an elastic developing sleeve is used.

The developing sleeve 2 is connected with a developing bias source 8. The developing bias source 8 forms an alternating electric field superposed with a DC component in the developing zone D between the developing sleeve 2 and at least an image portion of the image bearing member 1. By this, the developer is vibrated to deposit the developer to the image portion of the electrostatic latent image formed on the photosensitive drum 1.

A description will be made as to the magnet roll (magnetic field generating means) disposed stationarily in the developing sleeve 2, particularly the positions of the magnetic poles.

One 3*b* of the two magnetic poles 3*a* and 3*b* of the magnet roll 3 is disposed opposed to the developing zone D wherein the sleeve 2 is opposed to the photosensitive drum 1. The other magnetic pole 3*a* is disposed opposed to the opening 4*a* of the developer container 4. The magnetic pole 3*a* forms a magnetic field in a supplying zone S wherein the developer is supplied to the sleeve 2 in the container 4, and therefore, the magnetic field provided by the magnetic pole 3*a* attracts the developer in the container 4 to the sleeve 2. The magnetic pole 3*b* is effective to form a magnetic field in the developing zone D. By the magnetic field, the background of the image is prevented from receiving fog toner when the one component developer is used, and carrier particle deposition to the drum 1 is prevented when two component developer is used. The magnetic field in the developing zone D is contributable to prevention of scattering of the developer from the developing zone. The magnetic poles 3*a* and 3*b* are disposed at opposite sides interposing a center of the magnet roll 3. Preferably, they are substantially on a diameter line XY of the magnet roll 3, since then the influence of the magnetic fields provided by the magnetic poles is most efficiently used, so that a sufficient amount of the developer is deposited on the developing sleeve 2.

If the magnetic pole 3*a* is not within the opening 4*a* of the container 4, the amount of the developer deposited on the developing sleeve becomes insufficient with the result of formation of non-uniform image. By disposing the magnetic poles 3*a* and 3*b* on a diameter line of the magnet roll 3, a developer conveying force by the sleeve 2 from the magnetic pole 3*a* to the magnetic pole 3*b* can be made substantially equal to a developer conveying force by the sleeve 2 from the magnetic pole 3*b* to the magnetic pole 3*a*.

Even if the above-described bipolar magnet roll 3 is employed in a conventional magnet roll having a relatively large diameter, the conveyance of the developer is not desirable. This is because the conventional apparatus uses not less than two poles contributable to the conveyance of the developer in addition to the developing magnetic pole in the developing zone by employing a multi-pole magnet roll having three or more magnetic poles, but in the bipolar magnet roll, there is only one magnetic pole for the conveyance. It has been found that this problem can be solved by reducing the size of the developing sleeve 2, since sufficient conveyance of the developer can be obtained even if only two magnetic poles are formed in the magnet roll 3. This is one of the features of the present invention. Particularly, it is preferable when the outer diameter of the developing sleeve is 5–25 mm. Further preferably, the outer diameter of the sleeve 2 is not less than 8 mm and not more than 16 mm. The thickness of the sleeve 2 is preferably not less than 0.25 mm and not more than 1.5 mm. The clearance between the magnet roll 3 and the sleeve 2 is preferably 0.25 mm and not more than 1 mm as measured on a radius line of the sleeve. A usable diameter of the magnet roll 3 is not less than 3 mm and not more than 22 mm.

Figure 2:
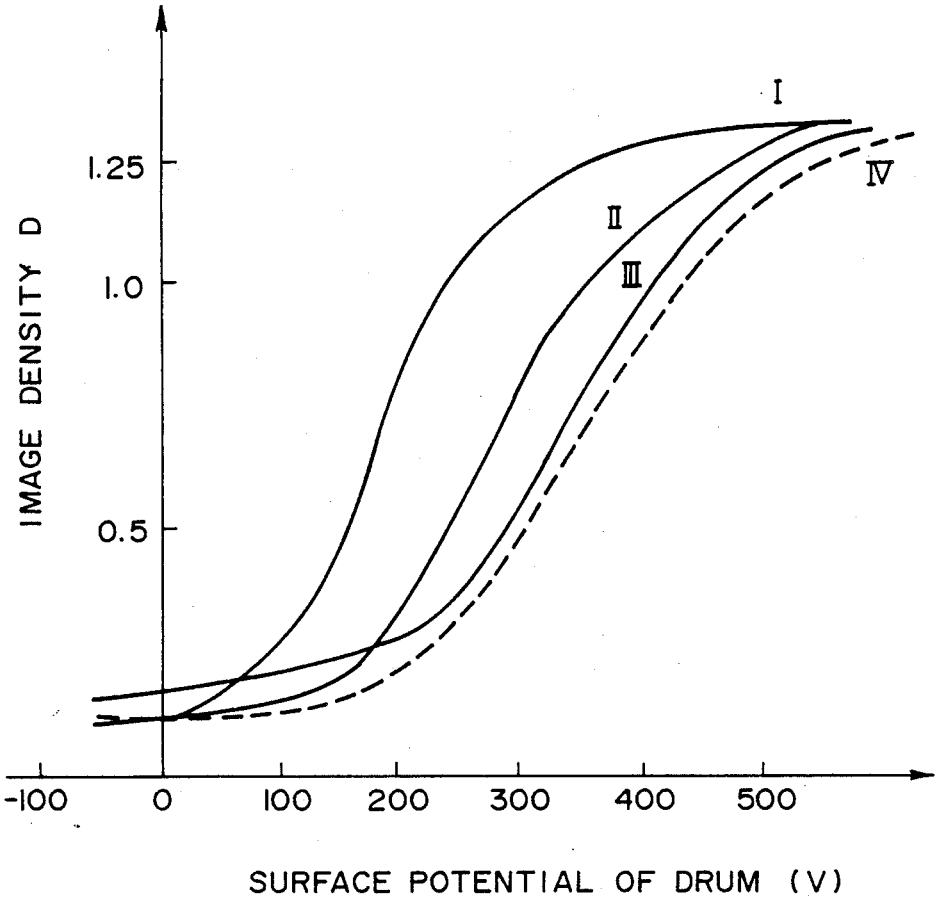
FIG. 2 is a graph showing a relationship between an image density and a surface potential of a photosensitive member.

Referring to FIG. 2, the description will be made as to the results of experiments on a tone reproducibility of the image, comparing with conventional examples.

FIG. 2 shows a graph of a reflection image density of a copy image measured by a MacBeth RD514 (trade mark) vs. a surface voltage of the drum without the voltage of the DC component applied to the developing sleeve. The surface voltage will hereinafter be called "SD potential". The parameter is an outer diameter of the developing sleeve.

The development was performed with a one component magnetic developer containing magnetic toner particles and a small amount of silica particles for improvement of fluidability. In the developing zone, a vibratory field is formed, under which the developer is transferred from the sleeve to the image portion of the photosensitive member.

The potential of the image portion of the latent image was −700 V, and that of the non-image portion was −200 V. The clearance between the photosensitive member and the sleeve was 300 microns at minimum. The bias voltage applied to the sleeve 2 was provided by superposing a DC voltage of −250 V with an AC voltage of 1.5 KHz and peak-to-peak voltage Vpp of 1.3 KV.

The experimental conditions of FIG. 2 are as follows:

Curve I: An outer diameter of the developing sleeve: 32 mm

Magnet roll: 4 poles forming an external magnetic field of 1000 Gauss on the developing sleeve:

Curve II: Outer diameter of the developing sleeve: 20 mm

Magnet roll: 4 poles forming an external magnetic field of 800 Gauss of the sleeve of the developing sleeve:

Curve III: An outer diameter of the developing sleeve: 10 mm

Magnet roll: 4 poles forming an external magnetic field of 500 Gauss of the surface of the developing sleeve: and Curve IV: Outer diameter of the developing sleeve: 10 mm Magnet roll: 2 poles forming an external magnetic field of 750 Gauss on the surface of the developing sleeve.

The curves I, II and III represent conventional 4 pole magnet roll, whereas the curve IV represents the two pole magnet roll according to this embodiment of the present invention. For all curves, the thickness of the sleeve was 0.8 mm, and the outer diameter of the magnet roll was smaller than the outer diameter of the sleeve by 2.6 mm.

From the results shown in FIG. 2, it is apparent:

that when the SD voltage is 0, the curve 3 has a higher density than the other curves; and that the curves 3 and 4 are less steep than the other curves.

The first point means production of a foggy background, and the image quality of the curve 3 is such that the deposition of the developer on the background of the copy image is so remarkable that it is not practically usable. The point 2 represent the reproducibility of the tone of the image. If it is steep, the tone reproducibility is not good. It is understood that the curve IV is good in the tone reproducibility. Therefore, the curve IV is preferable since the foggy background and the toner scattering are prevented, and the maximum image density Dmax is sufficiently high with good tone reproducibility and without non-uniformness of the image. It has been confirmed that this is the same in the range of 5–25 mm of the outer diameter of the developing sleeve.

Figure 3:
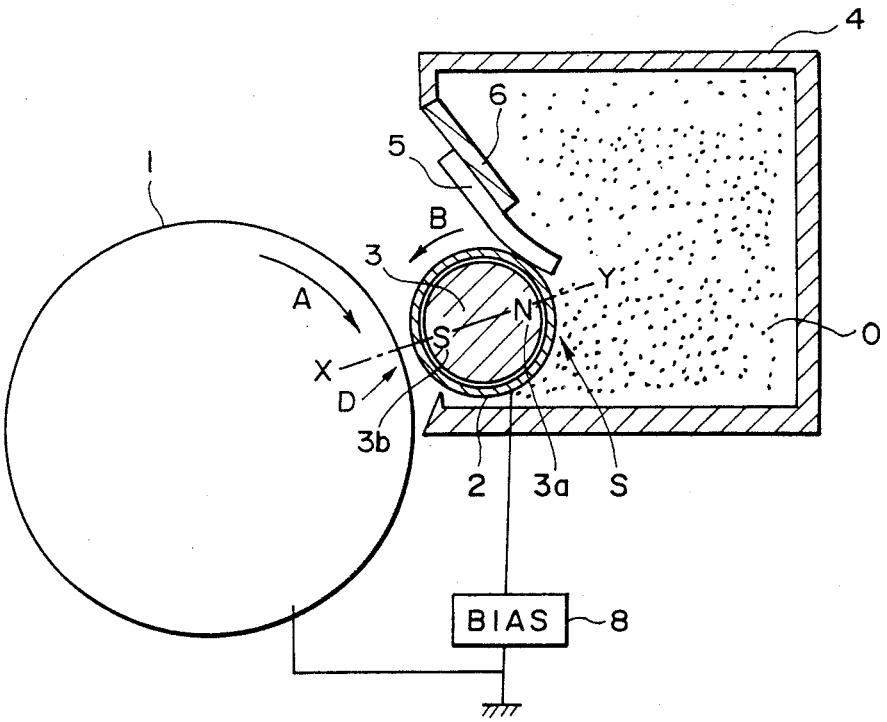
FIG. 3 is a sectional view of a developing apparatus according to another embodiment of the present invention.

In this embodiment, the non-magnetic thin plate 5 having an elasticity is contacted to the developing sleeve at its one surface, so that the opening of the developer container can be enlarged, that is, the supplying portion S can be enlarged as compared with a magnetic regulating member disposed with a clearance from the sleeve. Therefore, the latitude for the design of the developing device can be increased. As a result, the distance of conveyance of the developer on the developing sleeve to the regulating member can be made sufficiently large, and therefore, the triboelectrification to the developer is sufficient and stabilized. In this embodiment, the elastic member 5 contacted to the sleeve frictions with the developer, by which the toner can be sufficiently triboelectrically charged. Accordingly, the good image density can be provided despite the use of the small diameter sleeve. The thin elastic plate 5 of the non-magnetic material is contacted to the sleeve at a position downstream of the magnetic pole 3*a* with respect to the rotational direction of the sleeve 2. The magnetic field formed by the magnetic pole 3*a* is influential to the contact area between the thin elastic plate 5 and the sleeve 2. The thickness of the developer layer on the developing sleeve 2 can be decreased with the closeness of the contact portion toward the magnetic pole 3*a*. This is because, the magnetic regulating force is added to the mechanical regulating force. In the example of FIG. 1, the elastic plate 5 is contacted to the developing sleeve co-directionally with the rotational direction of the developing sleeve. Referring to FIG. 3, there is shown another embodiment of the present invention, wherein the elastic plate is contacted to the developing sleeve counter-directionally with respect to rotational direction of the sleeve. The present invention is applicable to such an arrangement of the elastic plate. The same results were obtained with such an arrangement of the non-magnetic thin elastic plate, that is, without scattering of the toner and the foggy background and with sufficient maximum image density and with good toner reproducibility and uniformity.

The non-magnetic thin plate may be made of phosphor bronze and a stainless steel in the form of a thin plate, which may be provided with rubber mounted thereto and contactable to the developing sleeve.

The surface of the developing sleeve is preferably roughened to 0.5–5 microns surface roughness through a known process, in order to increase the triboelectric charge of the toner and the conveyance of the developer. In this embodiment, the developing sleeve was made of aluminum having a surface sand-blasted by No. 400 particles.

A description will be made as to the bottom portion of the container 4 where the developer after development returns to the supplying portion S and where the developer in the container 4 can leak.

Figure 4:
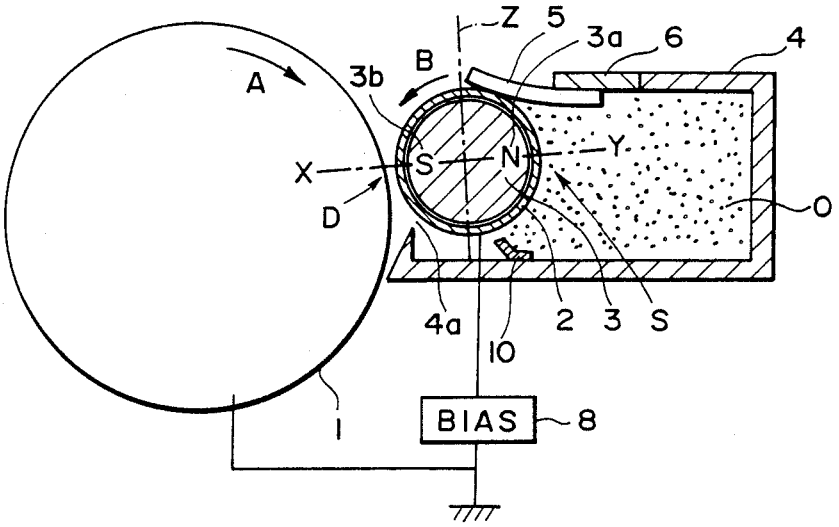
FIG. 4 is a developing apparatus according to a further embodiment of the present invention.

In FIG. 4, a magnetic member 10 is mounted to the developer container 4 in order to promote conveyance of the developer by the sleeve and to prevent the developer from leaking from the developer container 4. The position of the magnetic member 10 is within influence of the magnetic field formed by the magnetic pole 3*a* opposed to an inside of the developer container 4. Also, the magnetic member 10 is disposed upstream of the magnetic pole 3*a* with respect to the rotational direction of the developing sleeve 2.

In this specification, when an upstream or downstream position of a magnetic pole with respect to the rotational direction of the sleeve 2, is referred, it is based on the maximum magnetic flux density position on the surface of the sleeve. Also, a line passing through a magnetic pole means a line passing through the maximum magnetic flux position of the magnetic pole.

In FIG. 4, the magnetic member 10 is disposed on a bisector line Z of a line connecting the N and S poles 3*a* and 3*b* of the magnet roll 3, or at a position downstream of the bisector line Z and upstream of the N pole 3*a* with respect to the rotational direction of the developing sleeve 2. Since the magnetic member 10 is disposed opposed to the developing sleeve 2 at a position adjacent the bottom of the developer container 4, a part of the magnetic lines of force provided by the N pole 3*a* is concentrated on the magnetic member 10 at a position near the bottom of the developer container 4.

Figure 5:
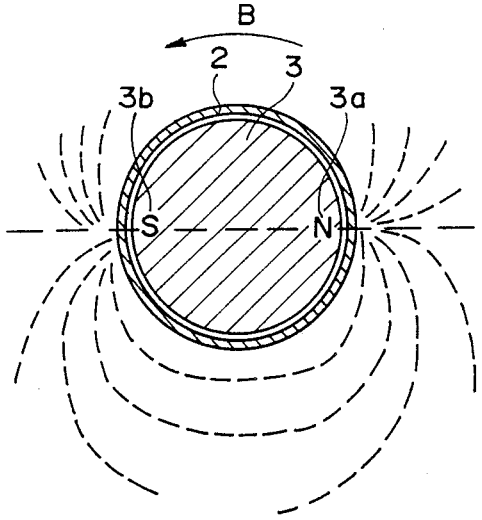
FIG. 5 is a sectional view of a part of a developing apparatus without magnetic seal, illustrating magnetic lines of force.
Figure 6A:
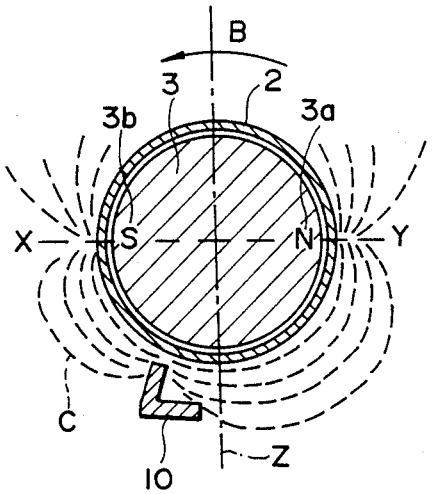
FIGS. 6A and 6B are sectional views of a part of a developing apparatus with a magnetic seal.
Figure 6B:
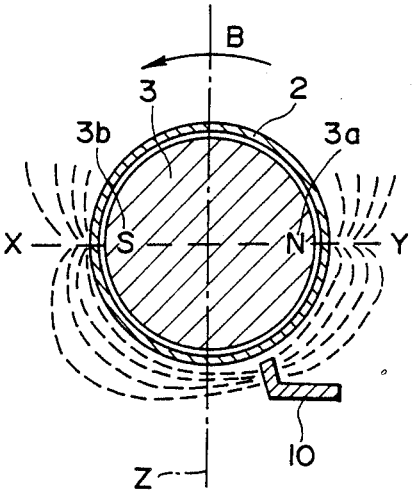

As shown in FIG. 5, when there is no magnetic member 10, the magnetic lines of force extend more away from the developing sleeve 2 with increase of a distance from the magnetic poles. As shown in FIGS. 6A and 6B, in the present invention employing the magnetic member 10, the magnetic lines of force extend between the magnetic poles at a high density adjacent the magnetic member, and are extended along the surface of the developing sleeve. Therefore, the force of deposition of the developer to the developing sleeve 2 is strong, by which the conveyance of the developer is increased with prevention of stagnation, leakage and scattering. In FIG. 6A, in order to make the magnetic force stronger between the developing S-pole 3*b* and the magnetic plate 10 than between the N-pole 3*a* and the magnetic member 10, the magnetic plate 10 is disposed upstream of bisector line Z of a line XY connecting the S and N poles (a line perpendicular to the line XY passing through the center of the sleeve, and therefore, of the magnet roll). Therefore, a slight amount of the developer is stagnated on the developing sleeve 2 at a portion C indicated in FIG. 6A, but the developer is conveyed to the developer container 4 because the magnetic force between the magnetic plate 10 and the N-pole 3*a* is strong as contrasted to FIG. 5 case. In FIG. 6B, the developer is not stagnated upstream of the magnetic member 10, and is conveyed in good order. In any case, the magnetic seal formed by the magnetic member 10 and the magnetic pole 3*a* is effective to prevent the leakage of the developer in the container 4. A method of magnetic sealing for the purpose of preventing leakage of the developer is disclosed in U.S. Pat. No. 4,638,760.

Figure 7:
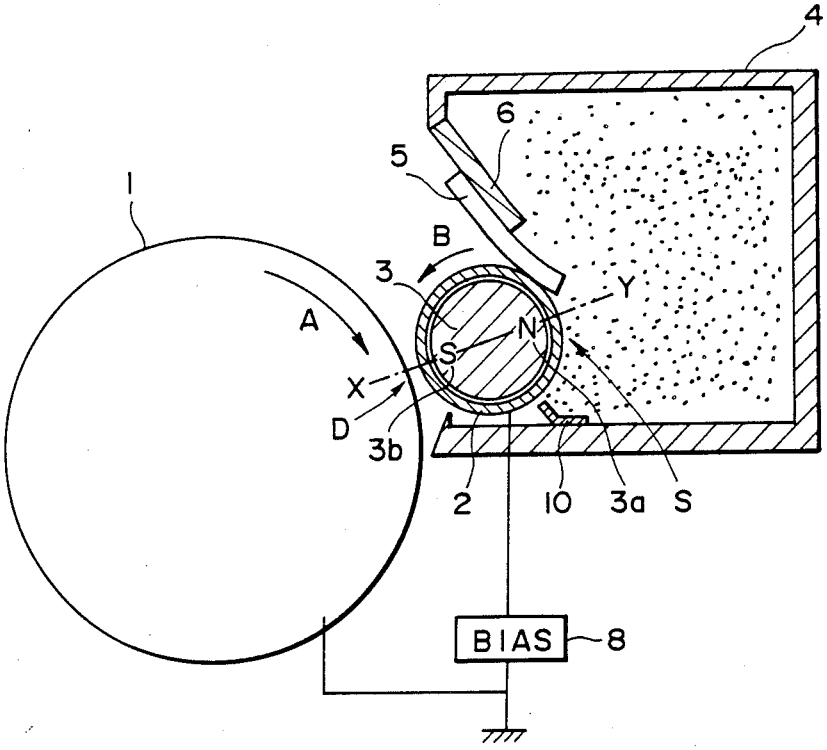
FIG. 7 is a sectional view of a developing apparatus according to a further embodiment of the present invention.

Referring to FIG. 7, there is shown an arrangement wherein a magnetic member 10 is provided in the apparatus of FIG. 3.

Figure 8:
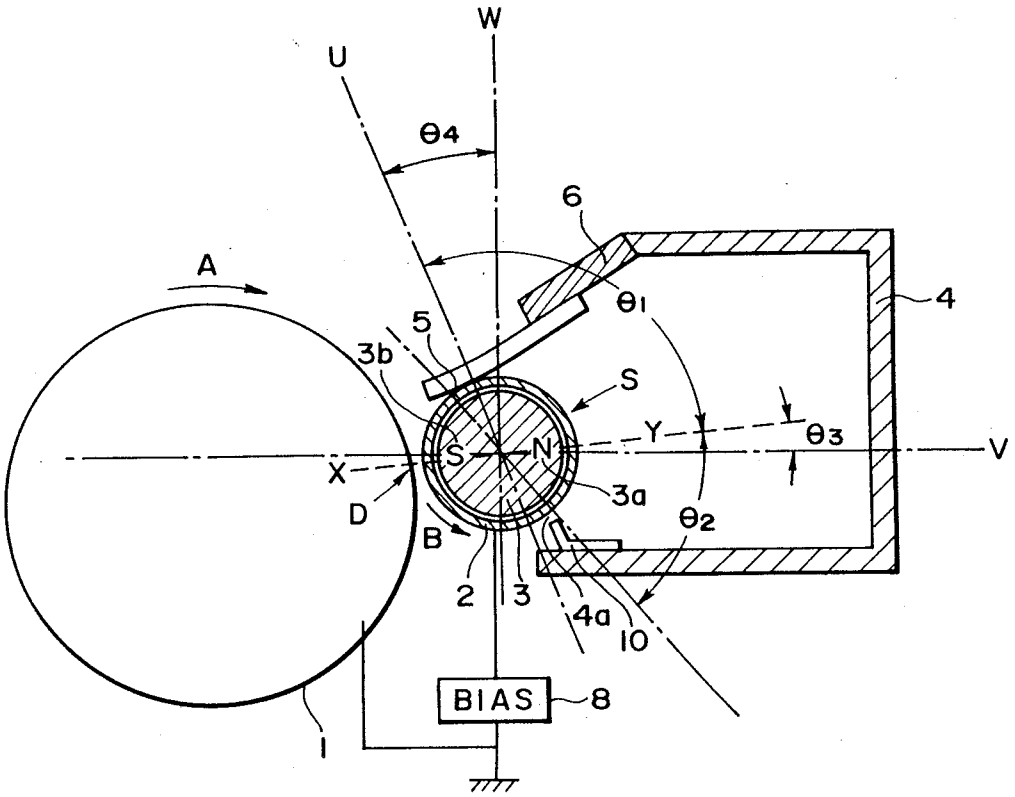
FIG. 8 is a sectional view of a developing apparatus according to a yet further embodiment of the present invention.

FIG. 8 shows a further embodiment of the present invention, wherein a magnetic member 10 is disposed upstream of the magnetic pole 3*a* with respect to the rotational direction of the sleeve 2 with a small clearance from the sleeve 2. It is preferable that a contact position between the regulating member, that is, the non-magnetic thin plate 5 and the developing sleeve 2 is closer to the photosensitive drum 1 than a radial line W passing through the rotational center of the developing sleeve. By doing so, gravity can be advantageously used so that the developer conveyance to the contact position is improved, and that a proper packed state of the developer can be provided immediately before the contact position, by which the application of the developer on the sleeve can be stabilized. Further, the contact position is disposed not only at the photosensitive drum side of the vertical line W but also in an upper side of a horizontal line V passing through the rotational center of the developing sleeve.

The position of the magnetic pole 3*a* disposed adjacent to the opening of the developer container 4 is preferably away from the contact position between the regulating member 5 and the developing sleeve 2 in order to ensure the above effects. If the magnetic pole 3*a* is disposed downstream of the center of the opening, that is, it is disposed near the contact position, the density of the developer in the space defined by the regulating member 5 and/or the supporting plate 6 is increased with the result that exchange (circulation) of the developer at the opening becomes somewhat difficult, and therefore, the developer is deteriorated, and the developer is triboelectrically charged on the developing sleeve too much in some case. Therefore, the position of the magnetic pole disposed adjacent the opening of the developer container is preferably upstream of the center of the developer container opening with respect to the rotational direction of the sleeve. Such a position also means that the magnetic pole 3*a* is near the magnetic member 10, so that the conveyance of the developer to be returned to the developer container 4 is improved.

Since in the FIG. 8 embodiment, the magnetic member 10 is disposed at an inlet side of the developer container 4, the developer is confined in this position, so that the confining force to the developer at the downstream side can be reduced. Also, the deterioration or the overcharge of the developer due to a local strong regulation by the regulating member 5, can be prevented, and therefore, it is preferable.

More specific figures in Example are $\theta 1=105$ degrees, $\theta 2=55$ degrees, $\theta 3=5$ degrees and $\theta 4=20$ degrees, where $\theta 1$ is an angle between a contact position between the regulating member 5 and the developing sleeve 2 and a magnetic pole 3*a* (N pole) at the opening 4*a* side as seen from the center of the sleeve;

$\theta 2$ is an angle formed between the N-pole 3*a* and the magnetic member;

$\theta 3$ is an angle formed between a line V (a horizontal line passing through the rotational center of the developing sleeve) and a line XY (a line connecting the N-pole and the S-pole; and $\theta 4$ is an angle formed between a line U (a line connecting the contact position and the center of the developing sleeve and a line W (a vertical line passing through the center of the developing sleeve).

With those angular relations, satisfactory results were obtained.

In this Specification, an angle formed between a portion and the center of the magnetic pole as seen from the center of the sleeve is the angle formed between the portion and the maximum magnetic flux density position on the sleeve surface.

A description will be made with respect to a preferable range of an amount of charge Q (Coul) per unit weight (g) of the developer and a weight G (g)/unit area (cm $^2$) in a layer of the developer formed on the sleeve 2 by the elastic regulating member 5. The preferable ranges are:

$$4.5\times10^{-9}\leq QG\leq 15\times10^{-9}\ (\text{Coul/cm}^2) \quad (1)$$

$$3\times10^{-6}\leq Q\leq 15\times10^{6}\ (\text{Coul/g}) \quad (2)$$

$$0.5\times10^{-3}\leqq G\leqq3\times10^{-3}\ (g/cm^2) \quad (3)$$

Figure 9:
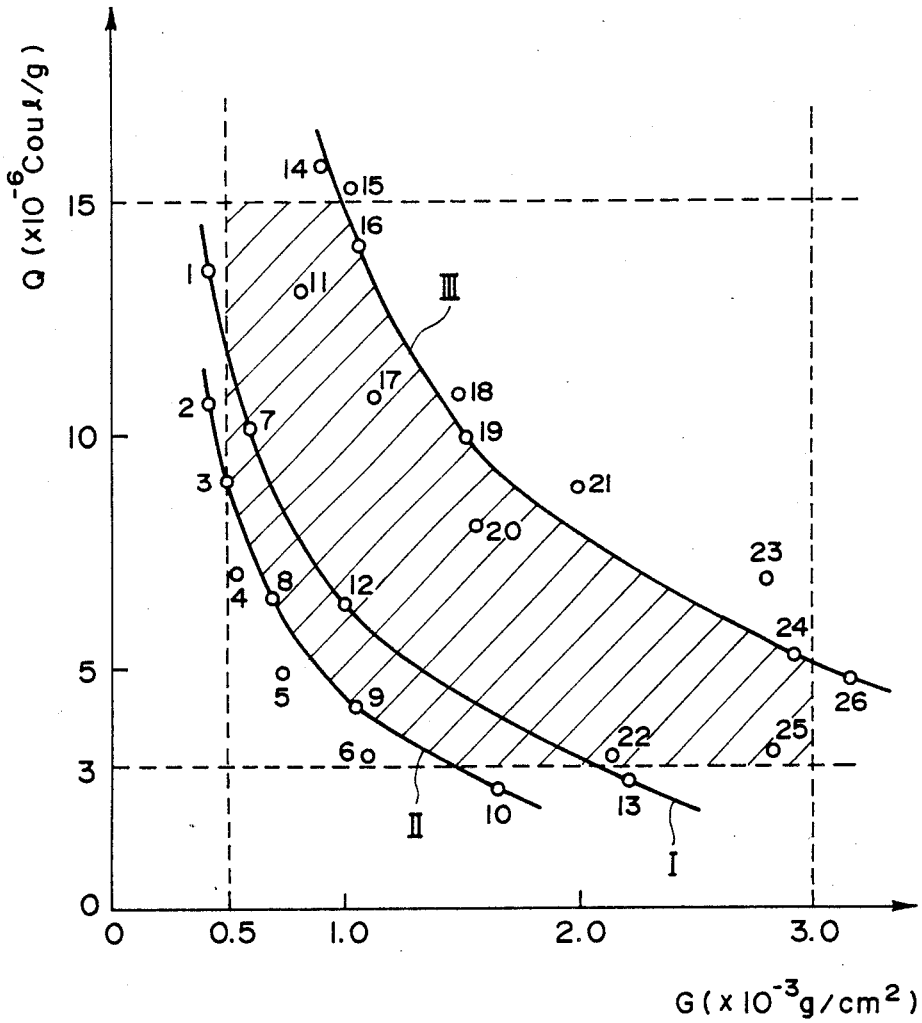
FIG. 9 is a graph showing a preferable range with respect to an amount of toner charge and an amount of toner application.

FIG. 9 is a graph of weight G ($g/cm^2$) of the layer of the one component magnetic developer applied on the sleeve and the amount of charge (Coul/g) per unit weight in a developing apparatus of FIG. 1.

Curve I represents a developing sleeve having an outer diameter of 10 mm with use of a black developer.

The regulating member was made of an urethane rubber plate having a rubber thickness of 65 degrees which is contacted to the developing sleeve at its antinoding side.

In FIG. 9, the amount of charge Q was changed by changing the friction conditions of the developer by the regulating member 5; the weight G was changed by changing the strength of the magnet 3a opposed to the developer container. Curves I, II and III were drawn indicating products of G and Q selected from the above. Therefore, on one curve, for example, the curve I indicating one constant product of G and Q, on which an increase of Q means the corresponding decrease of G, and vice versa, that is, the product of G and Q is constant.

The amount of charge Q and the weight G were measured in the following manner.

The amount of charge was measured by a modification of a sucking type Faraday gauge method which is ordinarily used, wherein a layer of the developer on the developing sleeve after passing by the regulating member is removed from the surface of the developing sleeve by a sucking means and is collected in a cell for a Faraday gauge. An amount of induced charge by the collected developer is measured by an electrometer to obtain the amount of charge. On the other hand, the weight G is determined by measuring the weight collected in the cell for the Faraday gauge by an electronic balance. The area of the developing sleeve from which the developer is sucked is measured to obtain the weight of the developer on the sleeve per unit area.

Various copy images were produced under different conditions of structural elements of the developing apparatus, and were evaluated in relation to the amount of charge Q, the weight G per unit area and the product thereof GQ. The developing process was of a so-called jumping development type which will be described hereinafter.

It has been found that background fog and toner scatter upon line image development, easily take place when the amount of electric charge of the layer of the developer on the developing sleeve is small, and are much more dependent on the amount of charge Q than the weight G; more particularly, they remarkably increased when $Q\leqq3\times10^{-6}$ Coul/g.

Increase of the triboelectric charge of the applied layer on the developing sleeve 2 results in the decrease of the electrostatic attracting force of the developer to the developing sleeve 2, and therefore, the decrease of the image density. It has been found in the experiments including durability test under low temperature conditions on the continuous operation basis that the image density is easily decreased when $Q\geqq15\times10^{-6}$ Coul/g. When the pressure by the elastic member 5 is increased in order to increase the charge amount Q, undesirable pressure is applied to the developer at the contact position between the elastic member 5 and the developing sleeve 2 with the result of coagulation of the developer, by which stripes are formed in the layer of the developer on the developing sleeve 2.

The maximum image density (Dmax) of the copy image and the collapse of a line image are much more dependent on the weight G than the charge amount Q. When $G\leqq0.5\times10^{-3}$ $g/cm^2$, Dmax is not sufficient, and therefore, the copy image density is low even if the charge amount Q is in the proper range. The image density can not be increased unless the developing sleeve 2 is rotated at a peripheral speed which is several times the peripheral speed of the photosensitive drum 1 to increase the supply of the developer. On the other hand, when $G\geqq3\times10^{-3}$ $g/cm^2$, the copy image density is sufficient, but the collapse of the line image is remarkable. Also, since the thickness of the toner layer is large, the toner deposition force to the developing sleeve 2 decreases with the result that the background fog and the toner scattering are increased. In this case, too, if the rotation of the developing sleeve 2 is made remarkably smaller than the moving speed of the photosensitive drum 1, the collapse of the line image becomes less remarkable. However, selection of the speed of the developing sleeve 2 which is remarkably different from the moving speed of the photosensitive drum 1, is not preferable in the developing apparatus according to this invention, since a trace of brushing becomes remarkable in the image.

From the foregoing, the weight of the developer and the charge amount of the toner are preferably in the following ranges:

$$3\times10^{-6}\leqq Q\leqq15\times10^{-6}\ (Coul/g)$$

$$0.5\times10^{-3}\leqq G\leqq3\times10^{3}\ (g/cm^2);$$

and further preferably $$4\times10^{-6}\leqq Q\leqq12\times10^{-6}\ (Coul/g)$$

$$1\times10^{-3}\leqq G\leqq2.5\times10^{-3}\ (g/cm^2)$$

As regards the product of the weight G and the charge amount Q, as shown in FIG. 9 by a curve II, if the product is smaller than $4.5\times10^{-9}$ ($Coul/cm^2$), it is disadvantageous from the standpoint of the image quality, as described hereinbefore. In addition, the conveyance properties of the developer are worsened due to the decrease of the magnetic force because of the small diameter of the sleeve, and therefore, the developer is more easily scattered and leaked from the developing device. In addition, the application of the developer on the developing sleeve is not saturated by one full turn of the developing sleeve rotation, resulting in production of a so-called negative sleeve ghost. Therefore, in the developing apparatus according to this invention, the following is preferable:

$$GQ\geqq4.5\times10^{-9}\ (Coul/cm^2).$$

The curve II was obtained when a developing sleeve having a diameter of 5 mm deemed as minimum was used.

The upper limit of the product was obtained using a developing sleeve having a diameter of 25 mm. This was indicated as a curve III in FIG. 10. It is indicated that if the product GQ is not less than $15\times10^{-9}$ ($Coul/cm^2$), the image quality is not enough. Therefore, $GQ\leqq15\times10^{-9}$ ($Coul/cm^2$) is preferable.

As a result, the weight G, the charge amount Q and the product GQ thereof preferably satisfy the inequations (1), (2) and (3). The preferable range is hatched in FIG. 10. The description will be made as to an embodiment wherein the conveying force for conveying the developer from the developing zone D to the container 4 is strengthened to further reduce the scattering, falling of the developer.

Figure 10:
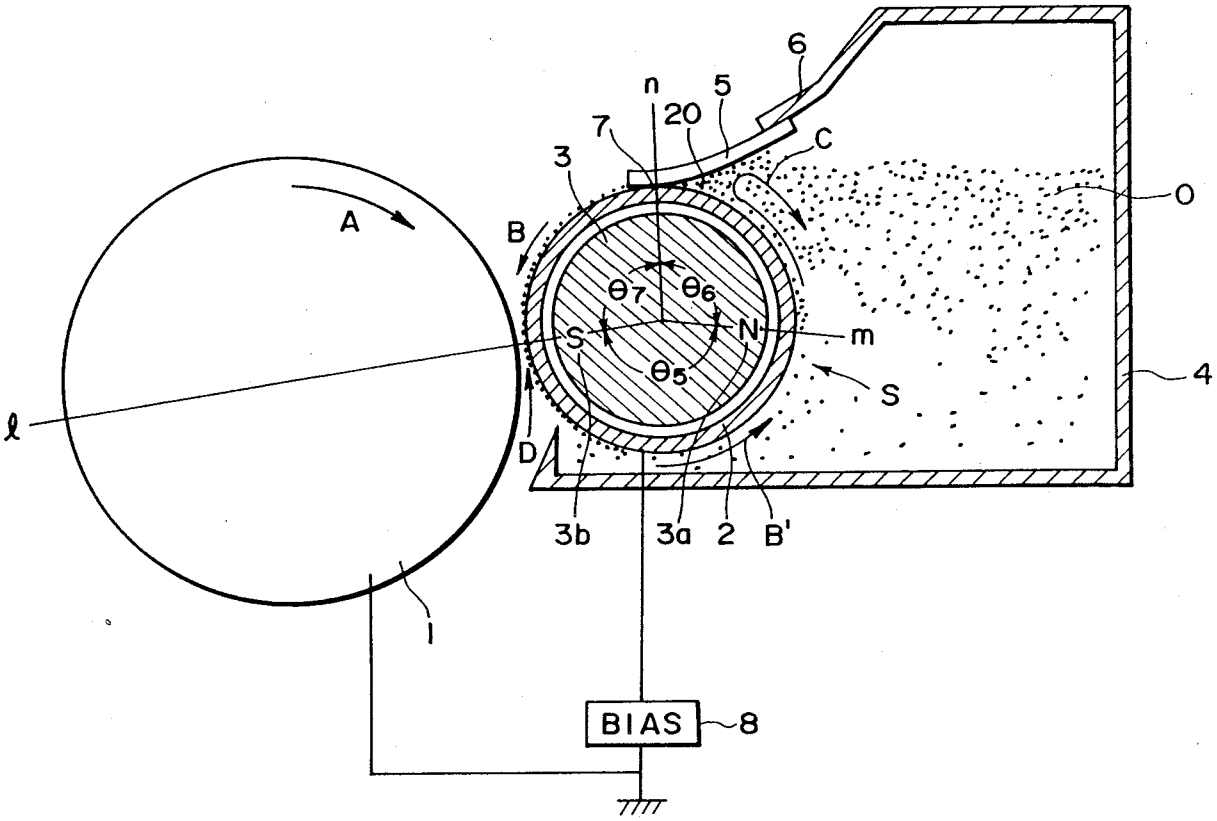
FIG. 10 is a sectional view of a developing apparatus according to a still further embodiment of the present invention.

In FIG. 10, radii l, m and n are the radii from the center of the magnet roll 3, and therefore, the center of the sleeve 2 to the two magnetic poles 3a, 3b and the center 7 of the contact portion of the regulating member 4 to the sleeve 2. The angles from those lines measured in the counterclockwise direction are $\theta 5$, $\theta 6$ and $\theta 7$.

Figure 11:
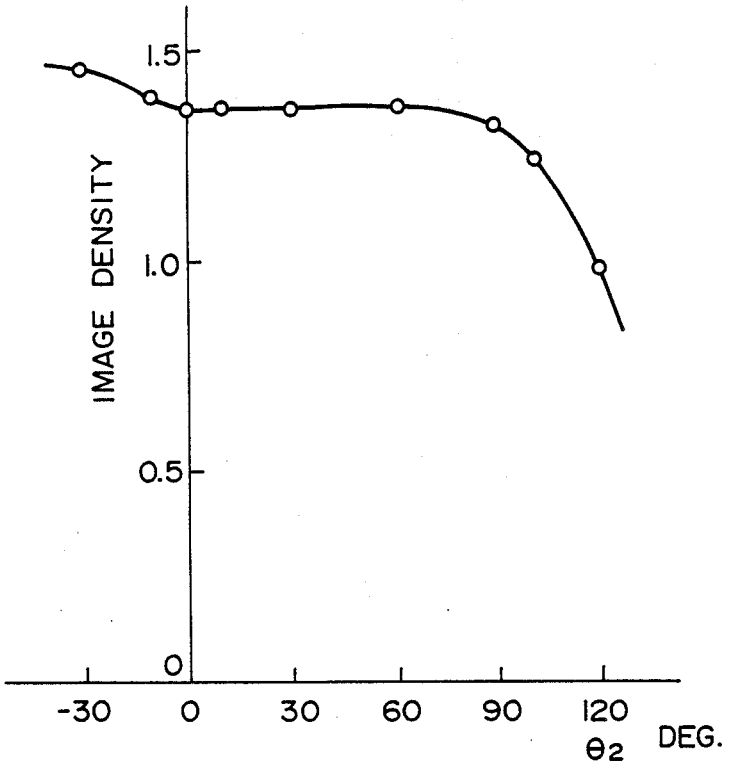
FIG. 11 is a graph of image density.

FIG. 11 shows a developing apparatus of this embodiment, wherein the magnetic pole 3a and 3b are disposed so that the angle $\theta 3$ is so determined so as to satisfy 120 degrees $\leqq \theta 5 \leqq 180$ degrees.

By disposing the two magnetic poles 3a and 3b in this manner, the toner conveyance from the developing zone D to the toner supplying portion S in the direction B' is increased so that the developer is prevented from scattering and falling at a bottom of the container 4. If the angle $\theta 5$ is smaller than 120 degrees, it becomes difficult to convey the toner 5 from the magnetic pole 3b toward the magnetic pole 3a in the direction B', so that it stagnates between the two magnetic poles to fall on an image. This is not dependent on the thickness of the layer even if the thickness of the developer on the developing sleeve is very thin. If the angle $\theta 5 < 180$ degrees, the toner after the development can not be sufficiently conveyed only by the rotation of the sleeve 2, and therefore, the toner is scattered from the bottom of the container in some cases. This is not dependent on the thickness of the developer layer.

In FIG. 11 embodiment, it is further preferable to satisfy 20 degrees $\leqq \theta 6 \leqq 100$ degrees by properly placing the magnetic pole 3a and the center of the contact portion 7. By doing so, the movement of the toner O in the direction C in FIG. 11, so that the toner contacted to the sleeve 2 is exchanged, and the toner is loosened sufficiently. Therefore, a necessary and sufficient amount of triboelectric charge can always be given to the toner O.

If the angle $\theta$ is larger than 100 degrees, the amount of toner O to the contact portion 7 decreases even if the angle $\theta$ is selected so as to provide the best conveyance. Therefore, the layer of the toner on the sleeve after regulated in the contact portion 7 becomes too thin, with the result that insufficient image density is provided when a solid black image is copied.

On the other hand, the toner O is regulated in its thickness by the contact portion 7, and simultaneously, it is supplied with the triboelectric charge. However, such toner as having received a small amount of triboelectric charge is blocked by the pressure contact between the blade 5 and the sleeve 2 and are not passed through the contact portion 7, since the electrostatic mirror force to the developing sleeve 2 is small. However, when $\theta 6 < 20$ degrees, a strong conveying force is given into the contact portion by the magnetic pole 3a, and therefore, the insufficiently charged toner is also passed through the contact portion 7. When such toner reaches the developing zone, it produces a foggy background in some cases. Therefore, it is preferable that $\theta 6$ is not less than 30 degrees to avoid the above-described influence of the magnetic force to the contact portion 7. If $\theta 7$ is smaller than 60 degrees, the toner in the toner stagnating region upstream of the contact portion 7 (designated by a reference 20 in FIG. 11) is relatively easily drawn through the contact portion 7 by the magnetic field provided by the magnetic pole 3b, even if the layer of the thicknesses is very small with the angle $\theta 6 = 100$ degrees. Therefore, it is preferable that the center of the magnetic pole 3b and the center of the contact portion are disposed so as to satisfy $\theta 7 \geqq 60$ degrees to avoid the foggy background or the like.

Referring back to FIG. 10, the magnetic pole 3a is preferably disposed on a horizontal plane containing the rotational center of the sleeve 2, since then the toner conveyance from the magnetic pole 3a to the magnetic pole 3b is assured, so that the toner in the toner stagnating region 20 (FIG. 10) is desirably circulated in the direction C.

The developing operations were actually performed with the following conditions. The angle $\theta 5$ was 150 degrees; the angle $\theta 6$ was 80 degrees and angle $\theta 7$ was 130 degrees. A latent image having a dark potential (image portion) of −700 V and a light potential (background) of −200 V was formed on the photosensitive drum. The developing gap in the developing zone D was 300 microns. The developing sleeve 10 was supplied with a superposed voltage of a DC voltage of −250 V and an AC voltage of approximately 1.3 KV (peak-to-peak voltage) and 1.5 KHz from a voltage source 8. The contact pressure of the blade 5 at the contact portion 7 was 50 g per 1 cm of a length of the sleeve 2. On the outer surface of the developing sleeve 2, a layer of the developer O having an average particle size of 11 microns was formed in the thickness of approximately 70–80 microns. The outer diameter of the developing sleeve 2 was approximately 10 mm, for example. The magnetic force by the magnetic poles 3a and 3b of the magnet roller 3 was 700 Gauss on the outer surface of the developing sleeve 2. The magnetic force provided bipolar magnet roller 3 strongly applies to the outer surface of the developing sleeve 2 in the developing zone D to provide longer magnetic brush of the developer O. In other words, the magnetic brush is sufficiently contacted to the photosensitive drum 1 to increase the development efficiency. In addition, the developing sleeve 2 is small in size, the developer O is sufficiently supplied to the developing zone D. Thus, a good image can be produced with sufficiently high image density.

Further, since the size of the developing sleeve 2 is small, the developing zone D is limited to the area wherein the sleeve is closest to the photosensitive drum 1 and adjacent thereto, a good image can be provided with good tone reproducibility. In such a developing apparatus, the angle $\theta$ was changed from 100 degrees to 180 degrees, and the angle $\theta 7$ was set 60 degrees so as to provide a maximum amount of toner on the developing sleeve as long as good images can be produced. When 120 degrees $\leqq \theta 5 \leqq 180$ degrees, the toner was conveyed in the direction B' in good order without stagnation or with very small stagnation practically negligible.

Figure 12:
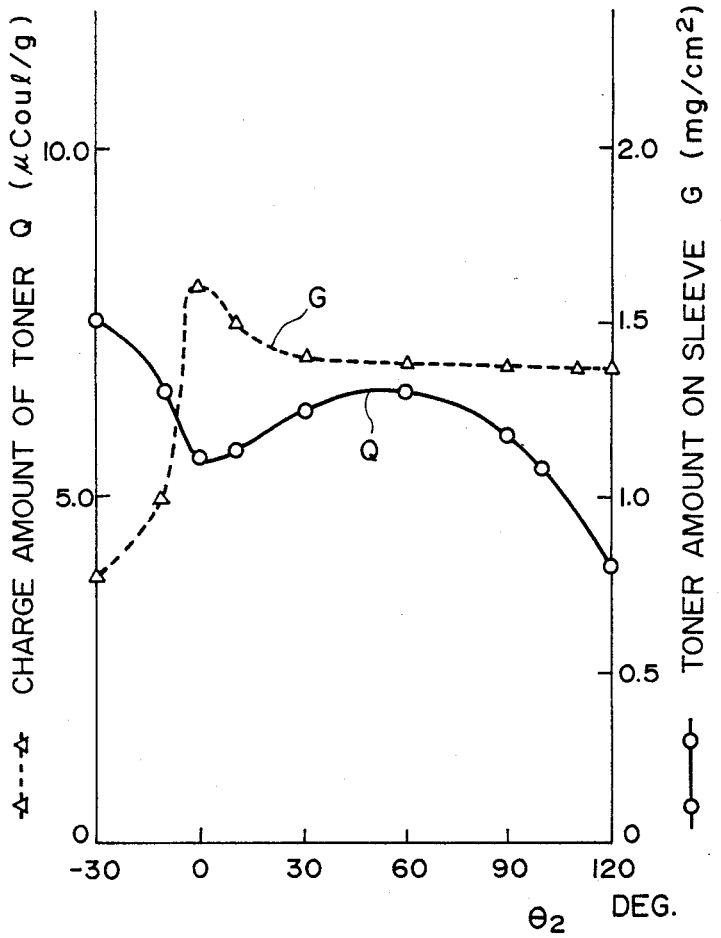
FIG. 12 is a graph showing a relation between an amount of toner charge and an amount of toner application.

FIG. 11 shows results of experiments wherein the angle $\theta 6$ was changed from −30 degrees to 120 degrees, and the angle $\theta 5$ was set 150 degrees to provide good conveyance of the developer in the direction B', in FIG. 10. FIG. 11 shows the change of the image density, and FIG. 12 shows changes of the triboelectric charge amount Q of the toner ($\mu$Coul/g) and weight G of the toner on the sleeve (mg/cm$^2$). It will be understood from overall standpoint, 20 degrees $\leqq \theta 6 \leqq 100$ degrees is preferably, since then, the conveyance of the developer on the developing sleeve after development is sufficient, and the developer having passed through the blade regulating position is sufficiently charged and is in the form of a stabilized thin coating of the developer. In addition, the sufficient image density is provided.

In FIG. 10, the non-magnetic elastic blade 5 may be contacted to the sleeve counter-directionally with respect to the rotation of the sleeve 2. The toner having an average particle size of not more than 10 microns which requires uniform and stabilized triboelectric charge application can be used.

In the foregoing embodiments, the layer thickness regulation of the developer is performed by the elastic blade 5. Since the diameter of the sleeve is small, the taper ratio of the wedge space formed between the blade and sleeve becomes large, which is preferable from the standpoint of prevention of coagulation of the developer in the space, even if the blade is co-directionally contacted to the sleeve.

The present invention is applicable not only to the electrophotographic copying apparatus, but also to a laser beam printer or an LED printer or the like, and also to a display apparatus. The present invention is applicable also to a reverse development apparatus wherein the toner is deposited onto an area having a low absolute value of the potential, in addition to an ordinary developing apparatus wherein the high potential portion in the absolute value receives the toner.

In addition, the present invention is applicable to a developing apparatus wherein the bias source 8 supplies a DC bias voltage to the developing sleeve.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing an electrostatic latent image, comprising:

a rotatable cylindrical member for carrying a developer to a developing zone, having an outer diameter of not less than 5 mm and not more than 25 mm;

means for supplying the developer to said cylindrical member in a supplying portion;

a stationary magnet disposed in said cylindrical member, said magnet having only first and second magnetic poles, wherein the first magnetic pole forms a magnetic field in the developing zone, and said second magnetic pole forms a magnetic field in the developer supplying portion; and an elastic member contacted to said cylindrical member to regulate a thickness of a layer of the developer supplied to the cylindrical member.

2. An apparatus according to claim 1, wherein said elastic member is disposed downstream of said second magnetic pole with respect to a rotational direction of the cylindrical member.

3. An apparatus according to claim 1 or 2, further comprising means for forming a vibratory electric field in the developing zone.

4. An apparatus according to claim 1 or 2, wherein said elastic member is contacted to said cylindrical member co-directionally with respect to a rotational direction of said cylindrical member.

5. An apparatus according to claim 1 or 2, wherein said elastic member is contacted to said cylindrical member counter-directionally with respect to a rotational direction of said cylindrical member.

6. A developing apparatus for developing an electrostatic latent image, comprising:

a rotatable cylindrical member for carrying a developer to a developing zone, having an outer diameter of not less than 5 mm and not more than 25 mm;

means for supplying the developer to said cylindrical member in a supplying portion;

a stationary magnet disposed in said cylindrical member, wherein said magnet having only first and second magnetic poles, wherein the first magnetic pole forms a magnetic field in the developing zone, and said second magnetic pole forms a magnetic field in the developer supplying portion;

an elastic member, contacted to said cylindrical member at a position downstream of said second magnetic pole with respect to a rotational direction of said cylindrical member, for regulating a thickness of a layer of the developer supplied to said cylindrical member; and a magnetic member disposed opposed to said cylindrical member in a path of the developer for returning the developer having passed through the developing zone to the supplying portion, said magnetic member is disposed in the magnetic field formed by said second magnetic pole at a position upstream of said second magnetic pole with respect to the rotational direction of said cylindrical member.

7. An apparatus according to claim 6, wherein said elastic member is disposed downstream of said second magnetic pole with respect to a rotational direction of the cylindrical member.

8. An apparatus according to claim 6 or 7, wherein said magnetic member is disposed downstream of a bisector of a line connecting said first and second magnetic poles with respect to the rotational direction of said cylindrical member.

9. An apparatus according to claim 6 or 7, wherein said magnetic member is disposed upstream of a bisector of a line connecting said first and second magnetic poles with respect to the rotational direction of said cylindrical member.

10. An apparatus according to claim 6 or 7, further comprising means for forming a vibratory electric field in the developing zone.

11. An apparatus according to claim 6 or 7, wherein said elastic member is contacted to said cylindrical member co-directionally with respect to a rotational direction of said cylindrical member.

12. An apparatus according to claim 6 or 7, wherein said elastic member is contacted to said cylindrical member counter-directionally with respect to a rotational direction of said cylindrical member.

13. An apparatus according to claim 6 or 7, wherein a contact portion between said elastic member and said cylindrical member is disposed at a developing zone side of a vertical line passing through a rotational center of said cylindrical member, and above a horizontal line passing through the rotational center.

14. A developing apparatus for developing an electrostatic latent image, comprising:

a rotatable cylindrical member for carrying a developer to a developing zone, having an outer diameter of not less than 5 mm and not more than 25 mm;

means for supplying the developer to said cylindrical member in a supplying portion;

a stationary magnet disposed in said cylindrical member, said magnet having only first and second magnetic poles, wherein the first magnetic pole forms a magnetic field in the developing zone, and said second magnetic pole forms a magnetic field in the developer supplying portion;

an elastic member contacted to said cylindrical member to regulate a thickness of a layer of the developer supplied to the cylindrical member; and wherein after the developer layer is regulated by said elastic member, an amount of charge of the developer Q (Coul/g) and weight of the developer on said cylindrical member G (g/cm$^2$) satisfy the following:

$$3\times10^{-6}\leqq Q\leqq 15\times10^{-6}$$

$$0.5\times10^{-3}\leqq G\leqq 3\times10^{-3}$$

$$4.5\times10^{-9}\leqq GQ\leqq 15\times10^{-9}.$$

15. An apparatus according to claim 14, wherein said elastic member is disposed downstream of said second magnetic pole with respect to a rotational direction of the cylindrical member.

16. An apparatus according to claim 14 or 15, further comprising means for forming a vibratory electric field in the developing zone.

17. An apparatus according to claim 14 or 15, wherein said elastic member is contacted to said cylindrical member co-directionally with respect to a rotational direction of said cylindrical member.

18. An apparatus according to claim 14 or 15, wherein said elastic member is contacted to said cylindrical member counter-directionally with respect to a rotational direction of said cylindrical member.

19. A developing apparatus for developing an electrostatic latent image, comprising:

a rotatable cylindrical member for carrying a developer to a developing zone, having an outer diameter of not less than 5 mm and not more than 25 mm;

means for supplying the developer to said cylindrical member in a supplying portion;

a stationary magnet disposed in said cylindrical member, said magnet having only first and second magnetic poles, wherein the first magnetic pole forms a magnetic field in the developing zone, and said second magnetic pole forms a magnetic field in the developer supplying portion, and wherein an angle formed between said first and second magnetic poles at a side opposite to a side where said elastic member is disposed, as seen from a rotational center of said cylindrical member, is not less than 120 degrees and not more than 180 degrees.

20. An apparatus according to claim 19, wherein said elastic member is disposed downstream of said second magnetic pole with respect to a rotational direction of the cylindrical member.

21. An apparatus according to claim 20, wherein an angle formed between said second magnetic pole and a contact portion between said elastic member and said cylindrical member as seen from the rotational center of set cylindrical member is not less than 20 degrees and not more than 100 degrees.

22. An apparatus according to claim 21, wherein an angle formed between said first magnetic pole and the contact portion as seen from the rotational center of said cylindrical member is not less than 60 degrees.

23. An apparatus according to claim 19, 20, 21 or 22, further comprising means for forming a vibratory electric field in the developing zone.

24. An apparatus according to claim 19, 20, 21 or 22, wherein said elastic member is contacted to said cylindrical member co-directionally with respect to a rotational direction of said cylindrical member.

25. An apparatus according to claim 19, 20, 21 or 22, wherein said elastic member is contacted to said cylindrical member counter-directionally with respect to a rotational direction of said cylindrical member.

26. A developing apparatus for developing an electrostatic latent image, comprising:

a rotatable cylindrical member for carrying a developer, having an outer diameter of not less than 5 mm and not more than 25 mm;

means for supplying a developer to said cylindrical member in a developer supplying portion;

a stationary magnet disposed in said cylindrical member, said magnet having only two magnetic poles adjacent a periphery thereof, wherein one of said magnetic poles forms a magnetic field in the supplying portion; and an elastic member contacted to said cylindrical member for regulating a thickness of a layer of the developer supplied on said cylindrical member;

wherein said elastic member is contacted to said cylindrical member counter-directionally with respect to a rotational direction of said cylindrical member.

27. A developing apparatus for developing an electrostatic latent image, comprising:

a rotatable cylindrical member for carrying a developer, having an outer diameter of not less than 5 mm and not more than 25 mm;

means for supplying a developer to said cylindrical member in a developer supplying portion;

a stationary magnet disposed in said cylindrical member, said magnet having only two magnetic poles adjacent a periphery thereof, wherein one of said magnetic poles forms a magnetic field in the supplying portion; and an elastic member contacted to said cylindrical member for regulating a thickness of a layer of the developer supplied on said cylindrical member;

wherein said elastic member is disposed downstream of said second magnetic pole with respect to a rotational direction of the cylindrical member; and wherein said elastic member is contacted to said cylindrical member counter-directionally with respect to a rotational direction of said cylindrical member.

* * * * *

UNITED STATES PATENT AND TRADEMARK OFFICE

CERTIFICATE OF CORRECTION

PATENT NO. : 4,936,249

DATED : June 26, 1990

INVENTOR(S) : HATSUO TAJIMA ET AL.

It is certified that error appears in the above-identified patent and that said Letters Patent is hereby corrected as shown below:

COLUMN 1

Line 67, "invention" (second occurrence) should be deleted.

COLUMN 2

Line 63, "are" should read --is--.
Line 67, "magnetic carrier particle" should read --magnetic carrier particles--.

COLUMN 3

Line 25, "propyrene" should read --propylene--.
Line 32, "mangane," should read --manganese,--,

COLUMN 5

Line 36, "of the sleeve" should read --on the surface--.
Line 40, "of" (second occurrence) should read --on--.
Line 62, "represent" should read --represents--.

COLUMN 8

Line 67, "$15x10^6$" should read --$15x10^{-6}$--.

COLUMN 11

Line 25, "toner 5" should read --toner 0--.
Line 36, "FIG. 11" should read --FIG. 10--.
Line 40, "FIG. 11" should read --FIG. 10--.
Line 49, "regulated" should read --being regulated--.
Line 57, "are" should read --is--.

UNITED STATES PATENT AND TRADEMARK OFFICE

CERTIFICATE OF CORRECTION

PATENT NO. : 4,936,249

DATED : June 26, 1990

INVENTOR(S) : HATSUO TAJIMA ET AL.

It is certified that error appears in the above-identified patent and that said Letters Patent is hereby corrected as shown below:

COLUMN 12

Line 2, "FIG. 11" should read --FIG. 10--.
Line 24, "developing sleeve 10" should read --developing sleeve 2--.

COLUMN 13

Line 1, "preferably," should read --preferable,--.

Signed and Sealed this

Fourteenth Day of July, 1992

*Attest:*

DOUGLAS B. COMER

*Attesting Officer*

*Acting Commissioner of Patents and Trademarks*